US009986794B2

(12) United States Patent
Greenspoon

(10) Patent No.: US 9,986,794 B2
(45) **Date of Patent: *Jun. 5, 2018**

(54) FASTENER

(71) Applicant: BibBoards, Inc., San Ramon, CA (US)

(72) Inventor: Robert Philip Greenspoon, Chicago, IL (US)

(73) Assignee: BibBoards, Inc., San Ramon, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/061,380

(22) Filed: Mar. 4, 2016

(65) Prior Publication Data

US 2016/0227888 A1 Aug. 11, 2016

Related U.S. Application Data

(63) Continuation of application No. 12/477,624, filed on Jun. 3, 2009, now Pat. No. 9,320,326.

(51) Int. Cl.

| | |
|---|---|
| ***A44C 3/00*** | (2006.01) |
| ***A44B 17/00*** | (2006.01) |
| ***A44B 1/28*** | (2006.01) |

(52) U.S. Cl.

CPC ..... *A44C 3/001* (2013.01); *A44B 1/28* (2013.01); *A44B 17/00* (2013.01); *A44D 2201/02* (2013.01); *Y10T 24/45225* (2015.01); *Y10T 24/45984* (2015.01)

(58) Field of Classification Search

CPC ..... A44B 17/00; A44D 2201/02; Y10T 24/45225; Y10T 24/45984

See application file for complete search history.

(56) References Cited

U.S. PATENT DOCUMENTS

| | | | | |
|---|---|---|---|---|
| 1,604,913 A | | 10/1926 | Hattingberg | |
| 1,733,650 A | | 10/1929 | Cummings | |
| 1,775,042 A | | 9/1930 | Lemoine | |
| 1,891,637 A | * | 12/1932 | Frank | A44B 17/00 24/666 |
| 2,041,606 A | | 5/1936 | Hofmann | |
| 2,118,561 A | | 5/1938 | Kleeberg | |
| 2,146,852 A | | 3/1947 | Schaaff et al. | |
| 2,491,310 A | | 12/1949 | Heimann | |
| 2,497,305 A | * | 2/1950 | Isaac | A44B 17/0011 24/114.4 |

(Continued)

FOREIGN PATENT DOCUMENTS

| | | |
|---|---|---|
| DE | 7900467 U1 | 5/1979 |
| DE | 29921649 U1 | 5/2000 |

(Continued)

*Primary Examiner* — David M Upchurch
(74) *Attorney, Agent, or Firm* — David M. Quinlan, P.C.

(57) ABSTRACT

A fastener assembly attaches items to fabrics and textiles. The fastener has particular application for easily attaching racing bibs (i.e., athlete numbers) to athletic garments, and obviating the need for safety pins. In one embodiment, a female portion that passes through the fabric or textile releasably connects with the male portion that fastens the item to the fabric or textile. In another embodiment, the female portion has a cover to facilitate passage through the fabric or textile. In a third embodiment, the male portion passes through the fabric or textile, and includes a barb or a hook to do so.

18 Claims, 3 Drawing Sheets

(56) References Cited

U.S. PATENT DOCUMENTS

| | | | | | |
|---|---|---|---|---|---|
| 2,647,261 | A | | 8/1953 | Rassner | |
| 2,685,690 | A | | 8/1954 | Chrisman | |
| 2,863,197 | A | * | 12/1958 | Statham | A44B 1/28 24/114.4 |
| 2,969,574 | A | * | 1/1961 | Blake | A44B 17/00 24/691 |
| 2,981,992 | A | | 5/1961 | Jawoll | |
| 3,010,169 | A | | 11/1961 | Carpinella | |
| 3,094,757 | A | * | 6/1963 | Blake | A44B 17/00 24/265 R |
| 3,259,006 | A | | 7/1966 | Dukatz et al. | |
| 3,416,200 | A | | 12/1968 | Daddona, Jr. | |
| 3,720,982 | A | | 3/1973 | Myers et al. | |
| 4,007,515 | A | * | 2/1977 | Agnelli | A44B 1/34 24/103 |
| 4,242,886 | A | | 1/1981 | Tucker | |
| 4,392,279 | A | | 7/1983 | Schwager | |
| 4,405,251 | A | | 9/1983 | Kolchinsky et al. | |
| 4,789,064 | A | | 12/1988 | Segal | |
| 4,875,237 | A | | 10/1989 | Cohen | |
| 4,959,890 | A | | 10/1990 | Pazurek | |
| 4,970,766 | A | * | 11/1990 | Hsiau | A44B 1/28 24/108 |
| 5,115,548 | A | * | 5/1992 | Nysten | A44B 1/08 24/113 MP |
| 5,299,324 | A | * | 4/1994 | Zinna | A41F 9/002 2/311 |
| 5,357,660 | A | | 10/1994 | Smith | |
| 5,581,815 | A | | 12/1996 | Hans | |
| 5,704,100 | A | | 1/1998 | Swan | |
| 6,266,853 | B1 | * | 7/2001 | Ho | A44B 1/28 24/105 |
| 6,408,444 | B1 | * | 6/2002 | Zinna | A41F 9/002 2/312 |
| 6,527,615 | B1 | | 3/2003 | Boehler | |
| 6,568,044 | B1 | | 5/2003 | Kidd | |
| 6,918,728 | B1 | | 7/2005 | Frauhammer et al. | |
| 7,788,772 | B2 | | 9/2010 | Dandurand | |
| 7,900,467 | B2 | | 3/2011 | Allen | |
| 8,595,867 | B1 | * | 12/2013 | Zinna | A45F 5/021 2/244 |
| 2006/0230583 | A1 | | 10/2006 | Chen | |
| 2008/0147116 | A1 | * | 6/2008 | Smith | A61B 17/0643 606/220 |
| 2011/0041295 | A1 | | 2/2011 | Reiter | |

FOREIGN PATENT DOCUMENTS

| | | |
|---|---|---|
| EP | 1634508 | 3/2006 |
| FR | 864346 | 4/1941 |
| FR | 1350098 | 12/1963 |
| FR | 2501803 | 3/1982 |
| GB | 153698 | 11/1920 |
| GB | 850884 | 10/1960 |
| GB | 951000 | 3/1964 |
| JP | 7-42327 | 10/1995 |
| JP | 2005189647 | 7/2005 |
| NL | 6611411 | 2/1968 |
| WO | 9204837 | 4/1992 |
| WO | 2009007476 | 1/2009 |
| WO | 2010043733 | 4/2010 |

* cited by examiner

FASTENER

FIELD OF THE INVENTION

The inventions described in this application relate to fasteners. The fasteners have particular application for fastening items to textiles and fabrics, e.g., for fastening a racing bib to an athlete's garment.

BACKGROUND AND STATE OF THE ART

Competitive athletes usually attach racing bibs to their racing garments using safety pins. The racing bibs contain a large name or number (possibly along with other information) to identify the athletes during the competition (e.g., running, cycling, skiing, etc.). The names/numbers have other functions, for instance to identify the athletes in photographs that vendors then sell to the depicted individuals. The bibs are often of TYVEK (a flexible lightweight spunbond polymer manufactured by DuPont), often have perforated portions that can be detached to serve as gear check receipts or drink tickets, and usually come with four openings near the corners spaced to facilitate attachment to garments.

Race organizers typically provide four safety pins to each athlete inside a race packet. The athlete collects the packet (and the pins) before the race. Safety pins can be difficult to use during the racing bib fastening process. They create a risk of skin-puncture; they have a tension bias that requires precise squeezing between the fingers to open or close them (where slippage creates further puncture risk); they are hard to manipulate in the dark (such as the night before a race when many athletes fasten their bib); they are hard to manipulate quickly (such as the moments before a race when late athletes rush to fasten their bib); they are hard to use for fastening a bib to a garment the athlete is presently wearing; they are not biodegradable; and they are not ideal for making a racing bib even, level and centered on a shirt. The attachment of racing bibs using safety pins can be a frustrating process.

U.S. Pat. No. 5,581,815 describes a specialized garment that comes with affixed prior art snap fasteners. The garment obviates the need for safety pins, since it permits easy fastening of information panels such as racing bibs.

SUMMARY OF THE INVENTION

The inventions described below obviate the need for (and one or more disadvantages of) safety pins for fastening items to textiles and fabrics. They have a distinct advantage over the inventions described in U.S. Pat. No. 5,581,815, in that an athlete may use them with garments the athlete already owns, and need not alter the garment. Of course, such fasteners have applications beyond competitive athletics, and embrace any application requiring easy fastening of one item to another.

A fastener assembly has a female portion containing a receptacle. The receptacle is a low profile shaft (e.g., a tube) that projects outwardly from a plane. The end of this shaft may be open (and thus ready to receive the knob of the male portion), or topped with a releasable cover shaped to allow passage through fabric (e.g., a conical top ending in a point). In the latter case, once the receptacle has been passed through the fabric, the cover may be released to expose the receptacle's opening. Since the opening has now passed through a fabric or textile, and since the female portion plane on the other side prevents total passage of the female portion through the fabric or textile, the male portion may now releasably engage the female portion. The male portion itself includes its own plane. In such a way, the plane of the female portion on one side of a garment may connect to the plane of the male portion on another side of the garment, thus fastening items securely to the garment.

The application will determine what material to use. For applications requiring durability and long wear, metallic compositions will be appropriate. For applications requiring light weight and that involve a single brief use (e.g., an athletic competition), polymer or decomposable food-based compositions will be appropriate.

DETAILED DESCRIPTION

Figure 1:
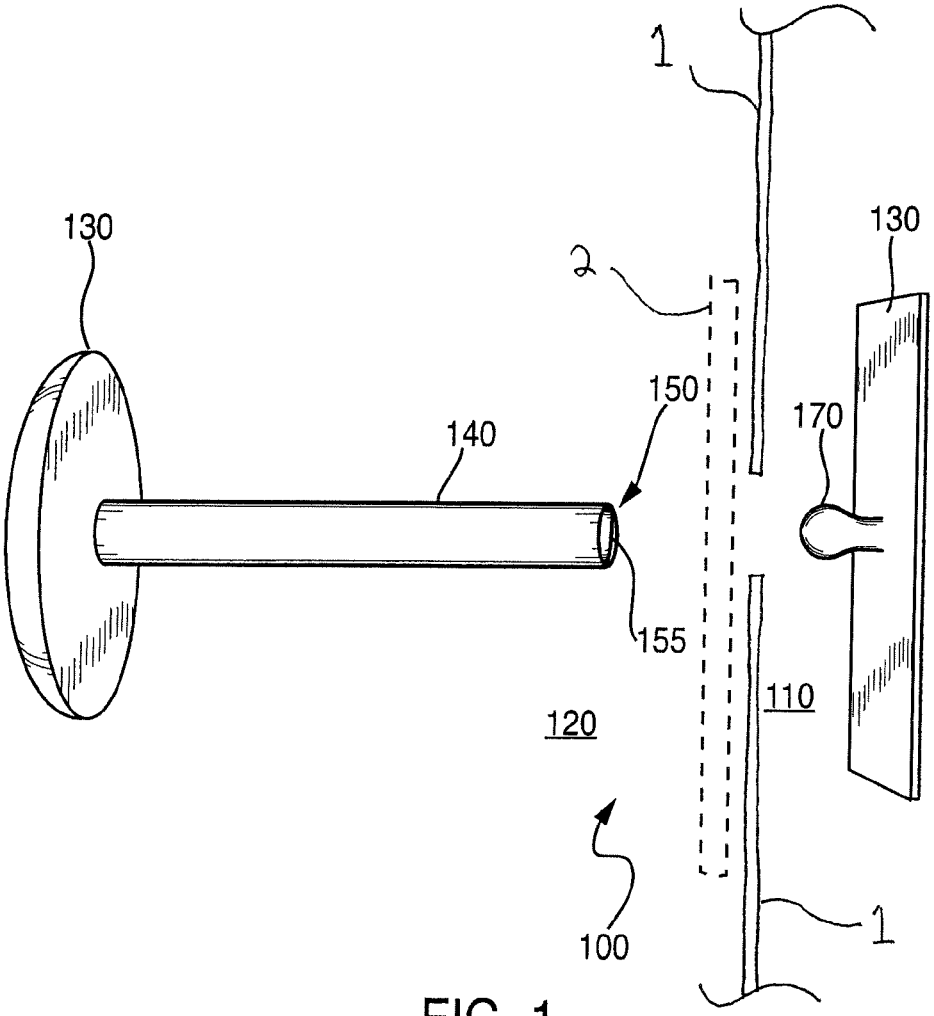
FIG. 1 depicts an example of the assembly of the present invention with a projecting receptacle.
Figure 2:
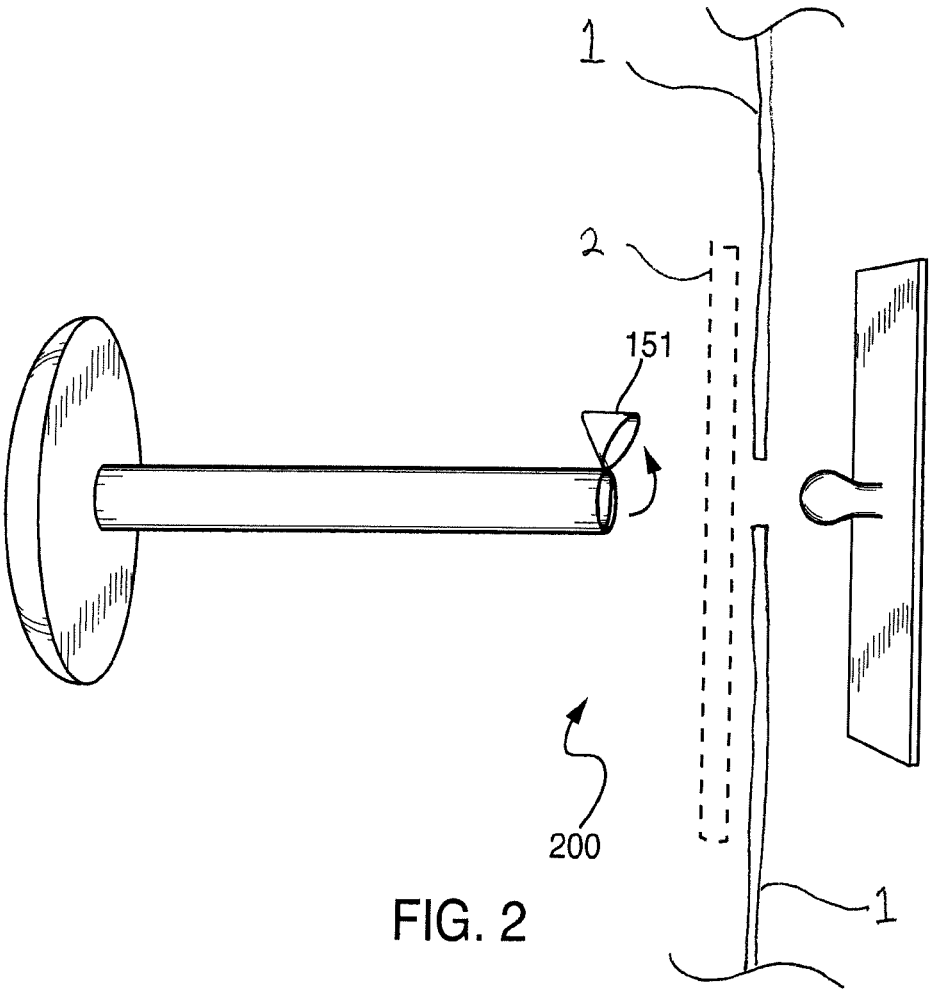
FIG. 2 depicts an example of the assembly of the present invention with a releasable cover over the receptacle opening.
Figure 3:
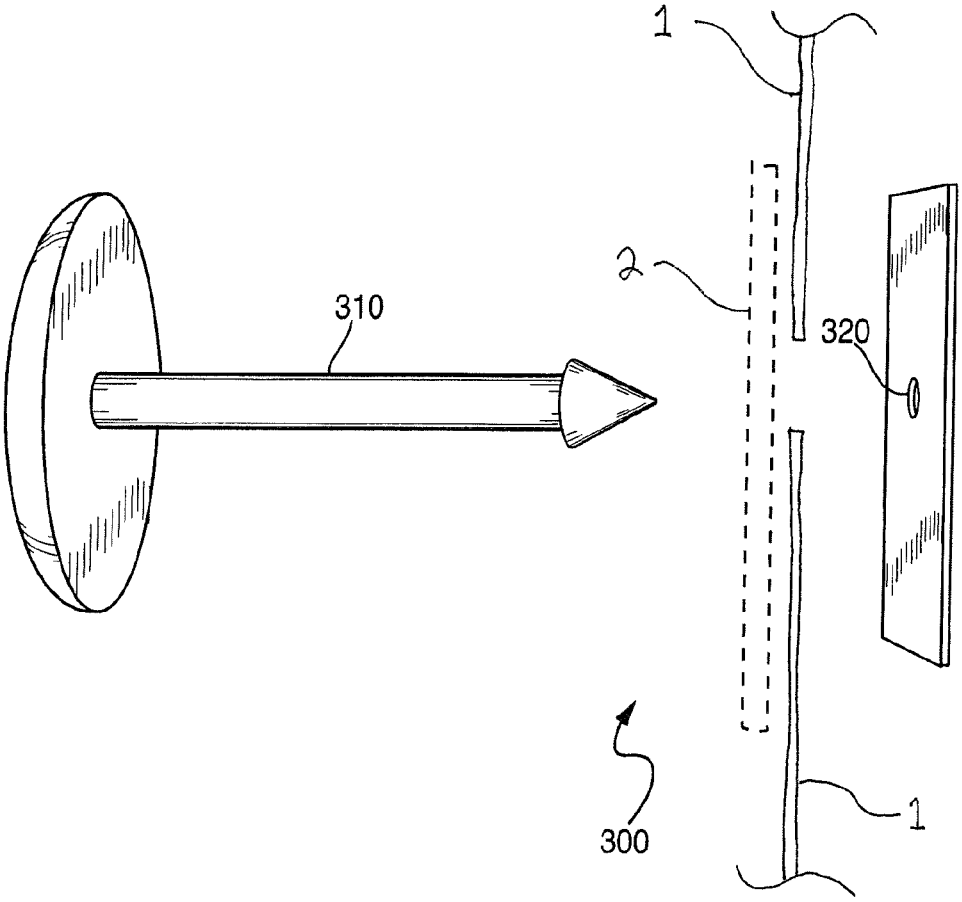
FIG. 3 depicts an example of the assembly of the present invention where a barb rather than a receptacle would pass through a fabric or textile.

The following detailed description of the inventions should not be viewed as limiting. Nor is any list of materials or alternatives intended to be limiting in way. The reader should consult the appended claims to define the property rights that the inventor intends to claim.

EXAMPLE 1

The fastener 100 of Example 1 includes a male portion 110 and a female portion 120.

The female portion 120 includes a plane 130 and a receptacle 140 projecting outwardly from the plane 130. (The term plane is not used in the purest sense, but rather in the sense of a somewhat rigid member, having a substantially flat region, from which another member might project). The receptacle 140 is a hollow tube. The end of the tube opposite the plane 130 has an opening 150. The receptacle 140 extends only slightly past the plane 130—just enough to permit the opening 150 to appear flush or nearly so to the surface of a fabric or textile 2 through which the receptacle might pass (preferably at least 2 mm, up to 10 mm). The opening may be a simple orifice, or alternatively may include a further assembly to create a spring bias against a mating knob (e.g., a metallic leaf spring 155, as in traditional prior art snap fasteners used in clothing).

The male portion 110 includes a plane 160 and a knob 170 projecting outwardly from the plane 160. The knob 170 is preferably sized to be slightly larger than the receptacle opening 150. It is well known in the art to size the knob of a fastener to create a snap fit when matably engaged with its corresponding female receptacle opening.

The two portions are mated with simple pressure. The two portions may then be released by pulling.

If the fastener is intended for attachment of a racing bib 1 to an athlete's garment 2, it should preferably be made of lightweight material and material that does not chafe, e.g., plastic. In this regard, the plane intended for the skin side of the garment 2 (whether male or female plane) should be shaped to minimize chafing, e.g., shaped as a wide-are dome. And, the plane intended to sandwich the racing bib 1 to the garment (whether male or female plane) should be sized to make sure the racing bib 1 stays on, e.g., 1-2 $cm^2$. If not plastic, the fastener (or portions of it) for this application may alternatively be made of food grade material (e.g., gelatin, corn starch, etc.) or other easily biodegradable compositions. Such materials would minimize the environmental impact of large-scale, single-site uses—e.g., the finish line of a large competition where thousands of people might release their fasteners all within a short time in a small area.

EXAMPLE 2

The fastener 200 of example 2 is identical to the fastener embodiments of example 1, except that the receptacle 140 of the female portion 120 now has a cover 151 over the opening 150. This cover 151 may be made of the same material or different material from the rest of the female portion 120. The cover 151 preferably is shaped to facilitate piercing of a fabric or textile 2. For instance, it may be a cone ending in a point.

The cover 151 is releasable. Two alternatives include complete removability, and hingeability that keeps the cover connected to the opening 150. In either case, releasability may be facilitated by including perforations in the material where the cover meets the opening, or by any other known means. In use, the user would peel away or otherwise release the cover 151, exposing the opening 150, prior to mating the male portion 110 to the female portion 120.

EXAMPLE 3

The fastener 300 of example 3 is identical to the fastener embodiments of either examples 1 or 2, except the portion that pierces the fabric or textile 2 is a male, not a female, portion. Instead of a knob, the male portion includes a barb 310. The barb 310 functions to pass through a fabric or textile 2 and allow engagement with a female portion. And now instead of a receptacle projecting from the female plane, the female portion includes an opening 320 that is flush (or nearly so) with a plane. The opening 320 is sized to permit releasable engagement between the barb and the opening.

Alternatively, a bent or curved hook may substitute for the barb. In this case, particularly if the hook is metallic, the bent or curved hook would permit easy passage through a fabric or textile 2, as well as secure engagement upon attachment, but would deform with sufficient pulling pressure to allow easy removal without damaging the fabric or textile 2 through which it must then pass.

I claim:

1. A fastener kit for removably fastening an identifying bib in the form of a sheet having a predetermined thickness with at least one aperture therethrough to a fabric athletic garment having a predetermined thickness, the kit including:

a one-piece female member unconnected to the bib or garment, the female member having a flat inner face and an opening with a continuous periphery; and a one-piece male member unconnected to the bib or garment, the male member having a flat inner face and a projecting member extending from the inner face of the male member to a distal portion having a knob, the projecting member and the knob being smaller than the aperture in the bib to permit the knob to pass through the aperture and to provide a predetermined clearance between the projecting member and the aperture, wherein:

the knob of the male member has smooth sides with a continuous periphery having substantially the same shape as the periphery of the opening, the opening is smaller than the knob for releasably capturing the knob with the inner face of the male member facing the inner face of the female member to temporarily secure the male and female members together and hold the bib and the garment between the respective inner surfaces of the male and female members, the opening of the female member and the knob of the male member are sized for permitting the knob to slide out of the opening to separate the male member and the female member from each other and release them from the bib and garment, and the male and female members are constructed so that when the knob of the male member is captured in the opening of the female member, the respective inner faces thereof are spaced from each other a distance greater than the combined thickness of the bib and the garment and the predetermined clearance between the projecting member and the aperture in the bib permits the bib to move relative to the garment.

2. The kit of claim 1, wherein the knob has rounded sides.

3. The kit of claim 1, wherein the opening of the female member and the knob of the male member have substantially circular peripheries.

4. The kit of claim 1, wherein the male and female members each have an outer face opposite its inner face, and the outer face of at least one of the male member and female member comprises a surface presenting a wide-arc dome.

5. The kit of claim 4, wherein the outer face of the female member comprises a surface presenting a wide-arc dome and the protrusion of the male member is constructed so that the knob does not protrude beyond the surface of the wide-arc dome of the female member when the knob is captured in the opening of the female member.

6. The kit of claim 1, wherein the knob is disposed at the terminal distal end of the projecting member.

7. A fastener kit for removably fastening an identifying bib in the form of a sheet having a predetermined thickness with at least one aperture therethrough to a fabric athletic garment having a predetermined thickness, the kit including:

a female member with an opening and a flat inner face; and a male member with a flat inner face and a projecting member extending from the inner face of the male member to a distal portion having a knob smaller than the aperture in the bib, wherein:

the opening of the female member has a continuous periphery, the knob of the male member has smooth sides with a continuous periphery having substantially the same shape as the periphery of the opening, the opening is smaller than the knob for releasably capturing the knob with the inner face of the male member facing the inner face of the female member to temporarily hold the bib on the garment between the respective inner surfaces of the male and female members, the opening of the female member and the knob of the male member are sized for permitting the knob to slide out of the opening to separate the male member and the female member, the male and female members are constructed so that when the knob of the male member is captured in the opening of the female member, the respective inner faces thereof are spaced from each other a distance greater than the combined thickness of the bib and the garment, and the female member includes a shaft portion having a proximal end attached to the inner face of the female member and projecting outwardly therefrom to a distal end having the opening therein, wherein the distal end of the shaft portion is sized to pierce the fabric of the garment.

8. The kit of claim 7, wherein the distal end of the shaft portion is spaced up to 10 mm from the proximal end.

9. The kit of claim 7, wherein the knob is held by frictional engagement of the smooth sides thereof with an inside surface of the opening.

10. The kit of claim 1, wherein the inner face of the male member has an area between 1 and 2 $cm^2$.

11. A fabric athletic garment with a predetermined thickness and a racing bib in the form of a sheet with a predetermined thickness, the athletic garment and racing bib being fastened together by at least one fastener assembly comprising a one-piece male member attached to a one-piece female member with the garment and the racing bib disposed between the female and male members, wherein:

the female member has an inner face and an opening with a continuous periphery;

the male member has an inner face and a projecting member extending from the inner face through an aperture in the bib to a distal portion having a knob with smooth sides with a continuous periphery having substantially the same shape as the periphery of the opening, the projecting member and the knob being smaller than the aperture in the bib to permit the knob to pass through the aperture and to provide a predetermined clearance between the projecting member and the aperture;

the knob of the male member is releasably held in the opening of the female member to temporarily secure the bib and the garment between the respective inner faces of the male and female members;

the opening of the female member and the knob of the male member are sized for permitting the knob to slide out of the opening to separate the male member and the female member from each other and release them from the bib and garment; and the inner faces of the male and female members are spaced from each other a distance greater than the combined thickness of the bib and the garment when the knob of the male member is captured in the opening of the female member and the predetermined clearance between the projecting member and the aperture in the bib permits the bib to move relative to the garment.

12. The athletic garment and racing bib of claim 11, wherein the knob has rounded sides.

13. The athletic garment and racing bib of claim 11, wherein the opening of the female member and the knob of the male member have substantially circular peripheries.

14. The athletic garment and racing bib of claim 11, wherein the male and female members each have an outer face opposite its inner face, and the outer face of at least one of the male member and female member comprises a surface presenting a wide-arc dome.

15. The athletic garment and racing bib of claim 14, wherein the female member is in contact with the athletic garment and the outer face of the female member comprises a surface presenting a wide-arc dome.

16. The athletic garment and racing bib of claim 15, wherein the protrusion of the male member is constructed so that the knob does not protrude beyond the surface of the wide-arc dome of the female member.

17. The athletic garment and racing bib of claim 11, wherein the knob is disposed at the terminal distal end of the projecting member.

18. The athletic garment and racing bib of claim 11, wherein the inner face of the male member has an area between 1 and 2 $cm^2$.

* * * * *